US010000910B2

(12) United States Patent
Wu

(10) Patent No.: US 10,000,910 B2
(45) Date of Patent: Jun. 19, 2018

(54) SHOVEL

(71) Applicant: SUMITOMO HEAVY INDUSTRIES, LTD., Tokyo (JP)

(72) Inventor: Chunnan Wu, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 430 days.

(21) Appl. No.: 14/695,159

(22) Filed: Apr. 24, 2015

(65) Prior Publication Data

US 2015/0225928 A1 Aug. 13, 2015

Related U.S. Application Data

(63) Continuation of application No. PCT/JP2013/071159, filed on Aug. 5, 2013.

(30) Foreign Application Priority Data

Oct. 29, 2012 (JP) ..... 2012-238376

(51) Int. Cl.
*E02F 9/22* (2006.01)
*F15B 21/14* (2006.01)
(Continued)

(52) U.S. Cl.
CPC ..... *E02F 9/2217* (2013.01); *E02F 9/123* (2013.01); *E02F 9/22* (2013.01); *E02F 9/2278* (2013.01); *F15B 1/024* (2013.01); *F15B 21/14* (2013.01); *F15B 1/033* (2013.01); *F15B 2211/20538* (2013.01); *F15B 2211/212* (2013.01); *F15B 2211/413* (2013.01); *F15B 2211/41518* (2013.01); *F15B 2211/426* (2013.01); *F15B 2211/6306* (2013.01);
(Continued)

(58) Field of Classification Search
CPC ..... F15B 1/024; F15B 21/14; E02F 9/2217
USPC ..... 60/414, 416
See application file for complete search history.

(56) References Cited

U.S. PATENT DOCUMENTS 4,674,280 A * 6/1987 Stuhr ..... F15B 1/02 180/165
4,731,997 A * 3/1988 Hagin ..... B60K 6/12 60/405
(Continued)

FOREIGN PATENT DOCUMENTS

JP S54-158403 U 11/1979
JP S56-170301 U 4/1981
(Continued)

OTHER PUBLICATIONS

International Search Report dated Nov. 12, 2013 (PCT/JP2013/071159).
(Continued)

*Primary Examiner* — Thomas E Lazo
(74) *Attorney, Agent, or Firm* — IPUSA, PLLC

(57) ABSTRACT

A shovel may be provided with a main pump, hydraulic actuators including a swing hydraulic motor, a control valve that controls a flow of a working oil between the main pump and the hydraulic actuators, and an accumulator part that releases the working oil between the main pump and the control valve, and between the swing hydraulic motor and the control valve. The accumulator part may release the working oil at an upstream of the main pump.

14 Claims, 7 Drawing Sheets

(51) Int. Cl.
*E02F 9/12* (2006.01)
*F15B 1/02* (2006.01)
*F15B 1/033* (2006.01)

(52) U.S. Cl.
CPC ..... *F15B 2211/6313* (2013.01); *F15B 2211/7058* (2013.01); *F15B 2211/7135* (2013.01); *F15B 2211/761* (2013.01); *F15B 2211/853* (2013.01); *F15B 2211/88* (2013.01)

(56) References Cited

U.S. PATENT DOCUMENTS

| | | | | |
|---|---|---|---|---|
| 6,981,371 | B2 * | 1/2006 | Imanishi | E02F 9/2225 60/420 |
| 7,823,379 | B2 * | 11/2010 | Hamkins | E02F 9/2217 60/414 |
| 7,908,852 | B2 * | 3/2011 | Zhang | E02F 9/2217 60/414 |
| 8,776,511 | B2 * | 7/2014 | Zhang | F15B 21/14 60/410 |
| 2003/0115863 | A1 | 6/2003 | Holt et al. | |
| 2007/0074509 | A1 | 4/2007 | Zhang et al. | |
| 2009/0217653 | A1 | 9/2009 | Zhang et al. | |

FOREIGN PATENT DOCUMENTS

| | | |
|---|---|---|
| JP | S61-013004 U | 1/1986 |
| JP | 2000-204604 | 7/2000 |
| JP | 2003-222105 | 8/2003 |
| JP | 2005-003183 | 1/2005 |
| JP | 2010-121726 | 6/2010 |
| JP | 2011-514954 | 5/2011 |
| JP | 2012-102881 | 5/2012 |

OTHER PUBLICATIONS

International Search Report dated Nov. 12, 2013 (PCT/JP2013/071160).
International Search Report dated Nov. 12, 2013 (PCT/JP2013/071161).

* cited by examiner

FIG.5

| | SWING RECOVERY | SWING MOTORING | PUMP SUPPLYING | CYLINDER DRIVING | NO-LOAD | PUMP ACCUMULATING |
|---|---|---|---|---|---|---|
| FIRST SELECTOR VALVE | COMMUNICATE | BLOCK | BLOCK | BLOCK | BLOCK | BLOCK |
| SECOND SELECTOR VALVE | BLOCK | COMMUNICATE | BLOCK | BLOCK | BLOCK | BLOCK |
| THIRD SELECTOR VALVE | COMMUNICATE | BLOCK | COMMUNICATE | COMMUNICATE | COMMUNICATE | BLOCK |
| FOURTH SELECTOR VALVE | BLOCK | BLOCK | BLOCK | COMMUNICATE | BLOCK | COMMUNICATE |

SHOVEL

RELATED APPLICATION

This application is a continuation application of International Application No. PCT/JP2013/071159 filed on Aug. 5, 2013 and designated the U.S., which is based upon and claims the benefit of priority of Japanese Patent Application No. 2012-238376, filed on Oct. 29, 2012, the entire contents of which are incorporated herein by reference.

BACKGROUND

Technical Field

The present invention relates to a shovel provided with an accumulator.

Description of Related Art

In related art, there is a proposed swing hydraulic motor control system that uses a single accumulator.

In this proposed swing hydraulic motor control system, in order to recover kinetic energy of inertia operation of a swing hydraulic motor as hydraulic energy when decelerating the swing hydraulic motor, working oil exited from the swing hydraulic motor is stored in an accumulator. In addition, in this swing hydraulic motor control system, in order to reuse the recovered oil energy as kinetic energy when accelerating the swing hydraulic motor, the working oil stored in the accumulator is supplied to the swing hydraulic motor.

However, this swing hydraulic motor control system is configured to use the working oil stored in the accumulator only for driving the swing hydraulic motor, and the accumulator is not necessarily used efficiently.

SUMMARY

According to one embodiment of the present invention, there is provided a shovel, including a main pump; hydraulic actuators including a swing hydraulic motor; a control valve configured to control a flow of a working oil between the main pump and the hydraulic actuators; and an accumulator part configured to release the working oil between the main pump and the control valve, and between the swing hydraulic motor and the control valve.

BRIEF DESCRIPTION OF THE DRAWINGS

FIG. 5 is a correspondence table indicating a corresponding relationship of states of the hydraulic circuit of FIG. 3 and states of each of selector valves;

DETAILED DESCRIPTION

A description will hereinafter be given of embodiments of the present invention with reference to the drawings.

In view of the related art described above, it is desirable to provide a shovel that can efficiently use the accumulator.

Embodiment

Figure 1:
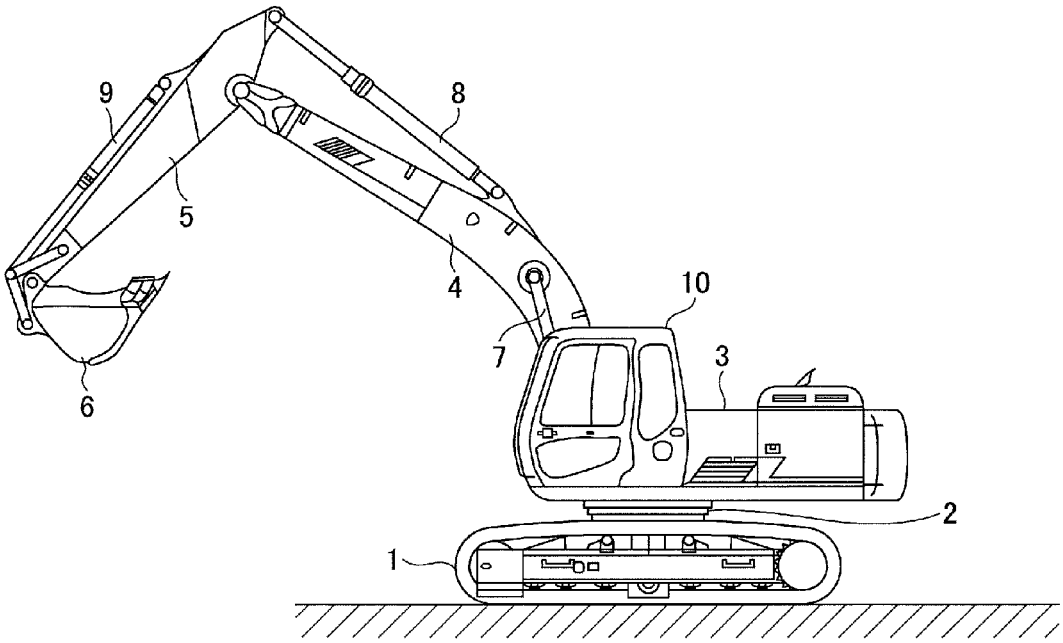
FIG. 1 is a side view of a hydraulic shovel according to one embodiment of the present invention.

FIG. 1 is a side view of a hydraulic shovel according to one embodiment of the present invention.

An upper structure 3 can be mounted on a lower structure of the hydraulic shovel via a slewing mechanism 2. A boom 4 can be mounted on the upper structure 3. An arm 5 can be mounted on a tip end of the boom 4, and a bucket 6 can be mounted on a tip end of the arm 5. The boom 4, the arm 5, and the bucket 6 may form an attachment. The boom 4, the arm 5, and the bucket 6 can be respectively driven hydraulically by a boom cylinder 7, an arm cylinder 8, and a bucket cylinder 9 which are hydraulic cylinders. A cabin 10 can be provided on the upper structure 3, and a driving source, such as an engine or the like, can also be provided on the upper structure 3.

Figure 2:
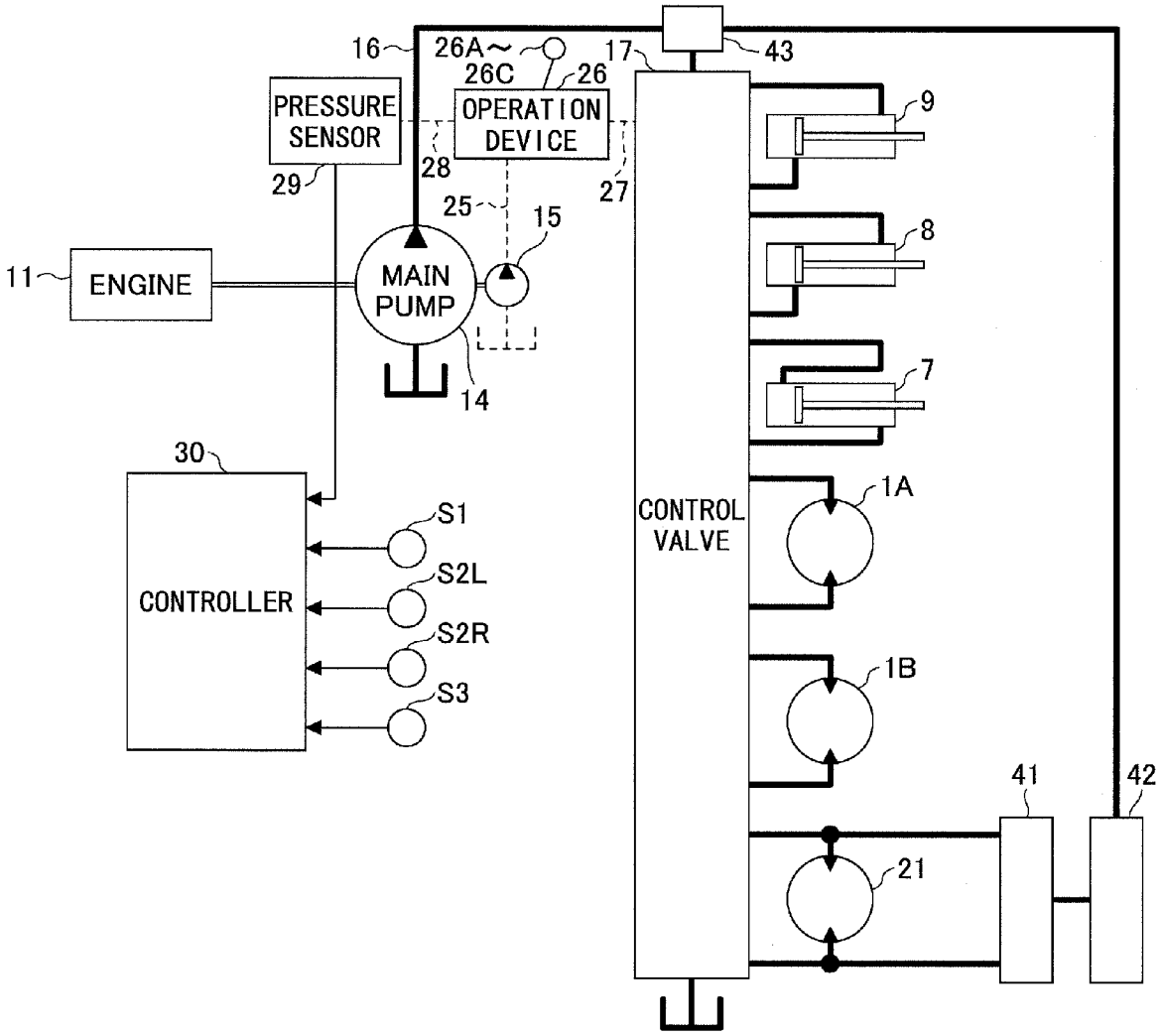
FIG. 2 is a block diagram illustrating a configuration of a driving system of the hydraulic shovel of FIG. 1.

FIG. 2 is a block diagram illustrating a configuration of a driving system of the hydraulic shovel of FIG. 1. In FIG. 2, a mechanical power system is indicated by a double line, a high-pressure hydraulic line is indicated by a bold solid line, a pilot line is indicated by a broken line, and an electrical drive and control system is indicated by a thin solid line.

A main pump 14 and a pilot pump 15, which may form a hydraulic pump, can be connected to an output shaft of an engine 11 which may form a mechanical drive part. A control valve 1 can be connected to the main pump 14 via the high-pressure hydraulic line 16 and a second release and accumulation switching part 43. In addition, an operation device 26 can be connected to the pilot pump 15 via a pilot line 25.

The control valve 17 can be a device for controlling a hydraulic system of the hydraulic shovel. Hydraulic actuators, such as hydraulic motors 1A (for the right side) and 1B (for the left side) of the lower structure 1, the boom cylinder 7, the arm cylinder 8, the bucket cylinder 9, a swing hydraulic motor 21, or the like can be connected to the control valve 17 via the high-pressure hydraulic line.

The operation device 26 may include a lever 26A, a lever 26B, and a pedal 26C. The lever 26A, the lever 26B, and the pedal 26C can be connected to each of the control valve 17 and a pressure sensor 29 via the hydraulic lines 2 and 28.

The pressure sensor 29 can be a sensor for detecting contents of an operation performed by an operator using the operation device 26. For example, the pressure sensor 29 may detect an operated direction and an operated amount of the lever or the pedal of the operation device 26 in the form of pressure, and output the detected value with respect to a controller 30. The contents of the operation performed from the operation device 26 may be detected using a sensor other than the pressure sensor.

The controller 30 may form a main control part for driving and controlling the hydraulic shovel. The controller 30 can be a device that is formed by a micro processor unit including a CPU (Central Processing Unit) and an internal memory, and can be realized by executing the CPU a program for the driving and controlling, stored in the internal memory.

A pressure sensor S1 can be a sensor for detecting a discharge pressure of the main pump 14, and outputs the detected value with respect to the controller 30.

A pressure sensor S2L can be a sensor for detecting a pressure of a working oil on a side of a first port of the swing hydraulic motor 21, and outputs a detected value with respect to the controller 30.

A pressure sensor S2R can be a sensor for detecting a pressure of the working oil on a second port side of the swing hydraulic motor 21, and outputs a detected value with respect to the controller 30.

A pressure sensor S3 can be a sensor for detecting a pressure of the working oil in an accumulator part 42, and outputs a detected value with respect to the controller 30.

A first release and accumulation switching part 41 can be a hydraulic circuit element for controlling a flow of the working oil between the swing hydraulic motor 21 and the accumulator part 42.

The accumulator part 42 can be a hydraulic circuit element for accumulating excess working oil within the hydraulic circuit, and releasing the accumulated working oil according to needs.

The second release and accumulation switching part 43 can be a hydraulic circuit element for controlling a flow of the working oil amongst the main pump 14, the control valve 17, and the accumulator part 42.

A detailed description of the first release and accumulation switching part 41, the accumulator part 42, and the second release and accumulation switching part 43 will be given later.

Figure 3:
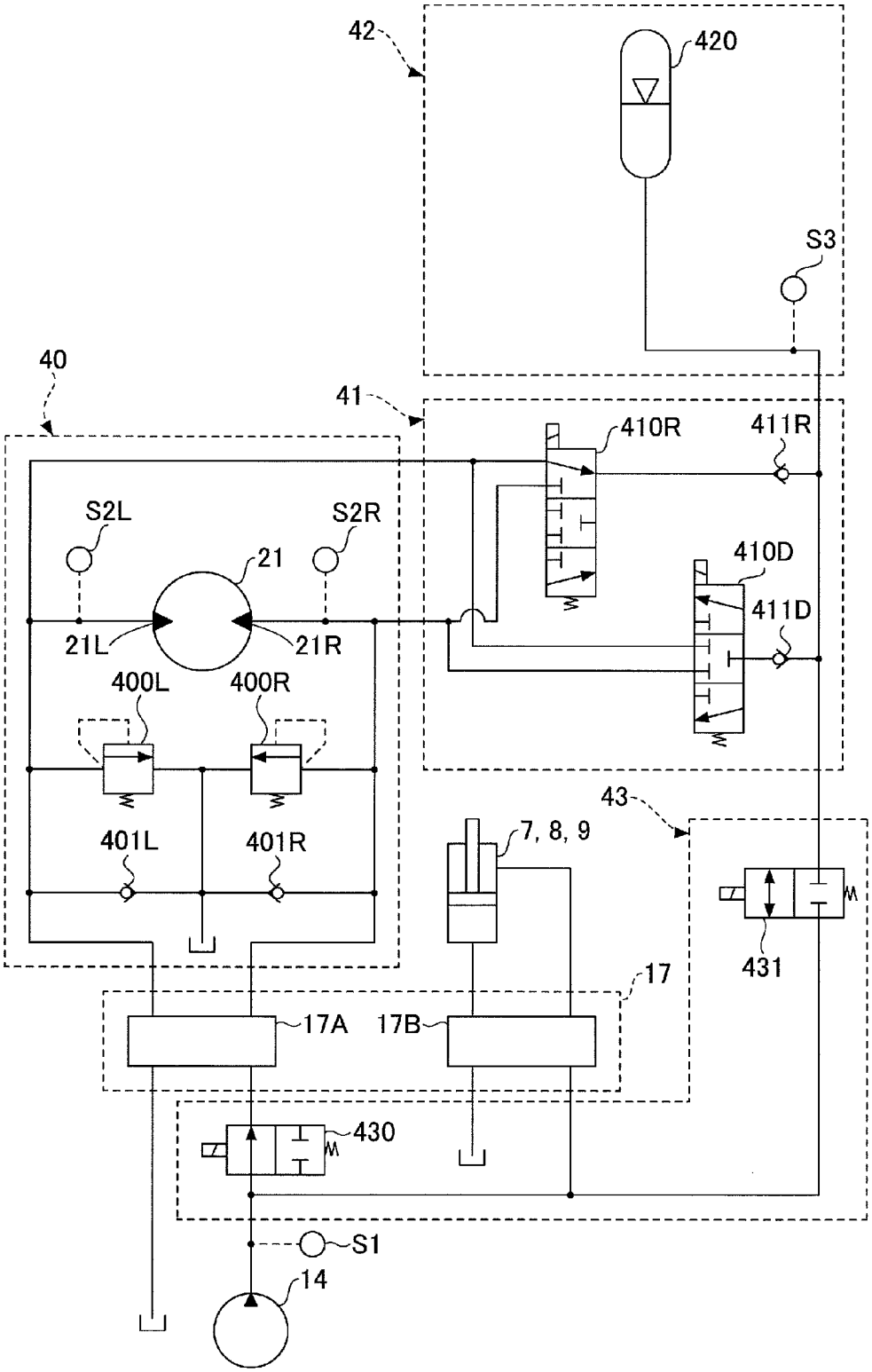
FIG. 3 is a diagram illustrating an example of a main configuration of a hydraulic circuit according to an embodiment.

Next, a description will be given of the accumulating and releasing of the accumulator part 42 that is provided on the hydraulic shovel of FIG. 1, by referring to FIG. 3. FIG. 3 is a diagram illustrating an example of a main configuration of a hydraulic circuit according to an embodiment, provided on the hydraulic shovel of FIG. 1.

The main configuration of the hydraulic circuit illustrated in FIG. 3 may mainly include a swing control part 40, the first release and accumulation switching part 41, the accumulator part 42, and the second release and accumulation switching part 43.

The swing control part 40 may mainly include the swing hydraulic motor 21, relief valves 400L and 400R, and check valves 401L and 401R.

The relief valve 400L can be a valve for preventing the pressure of the working oil on the side of a first port 21L of the swing hydraulic motor 21 from exceeding a predetermined swing relief pressure. More particularly, the relief valve 400L may eject the working oil on the side of the first port 21L to a tank in a case in which the pressure of the working oil on the side of the first port 21L reaches the predetermined swing relief pressure.

Similarly, the relief valve 400R can be a valve for preventing the pressure of the working oil on the side of a second port 21R of the swing hydraulic motor 21 from exceeding a predetermined swing relief pressure. More particularly, the relief valve 400R may eject the working oil on the side of the second port 21R to the tank in a case in which the pressure of the working oil on the side of the second port 21R reaches the predetermined swing relief pressure.

The check valve 401L can be a valve for preventing the working oil on the side of the first port 21L from becoming less than a tank pressure. More particularly, the check valve 401L may supply the working oil within the tank to the side of the first port 21L in a case in which the pressure of the working oil on the side of the first port 21L decreases to the tank pressure.

Similarly, the check valve 401R can be a valve for preventing the working oil on the side of the second port 21R from becoming less than the tank pressure. More particularly, the check valve 401R may supply the working oil within the tank to the side of the second port 21R in a case in which the pressure of the working oil on the side of the second port 21R decreases to the tank pressure.

The first release and accumulation switching part 41 can be a hydraulic circuit element for controlling a flow of the working oil between the swing control part 40 (swing hydraulic motor 21) and the accumulator part 42. In this embodiment, the first release and accumulation switching part 41 may mainly include a first selector valve 410R, a second selector valve 410D, and check valves 411R and 411D.

The first selector valve 410R can be a valve for controlling a flow of the working oil from the swing control part 40 to the accumulator part 42 at the time of an accumulation (recovery) operation of the accumulator part 42. In this embodiment, the first selector valve 410R can be a 3-port 3-position selector valve, and may be formed by a solenoid valve that switches a valve position thereof according to a control signal from the controller 30. In addition, the first selector valve 410R may be formed by a proportional valve that uses the pilot pressure. More particularly, the first selector valve 410R can have a first position, a second position, and a third position as the valve positions thereof. The first position may be the valve position for communicating the first port 21L and the accumulator part 42. Moreover, the second position may be the valve position for blocking the swing control part 40 and the accumulator part 42 from each other. Further, the third position may be the valve position for communicating the second port 21R and the accumulator part 42.

The second selector valve 410D can be a valve for controlling a flow of the working oil from the accumulator part 42 to the swing control part 40 at the time of a release (motoring) operation of the accumulator part 42. In this embodiment, the second selector valve 410D can be a 3-port 3-position selector valve, and may be formed by a solenoid valve that switches a valve position thereof according to a control signal from the controller 30. In addition, the second selector valve 410D may be formed by a proportional valve that uses the pilot pressure. More particularly, the second selector valve 410D can have a first position, a second position, and a third position as the valve positions thereof. The first position may be the valve position for communicating the accumulator part 42 and the first port 21L. Moreover, the second position may be the valve position for blocking the accumulator part 42 and the swing control part 40 from each other. Further, the third position may be the valve position for communicating the accumulator part 42 and the second port 21R.

The check valve 411R can be a valve for preventing a flow of the working oil from the accumulator part 42 to the swing control part 40. In addition, the check valve 411D can be a valve for preventing a flow of the working oil from the swing control part 40 to the accumulator part 42.

In the following description, a combination of the first selector valve 410R and the check valve 411R may also be referred to as a first accumulator (recovery) circuit, and a combination of the second selector valve 410D and the check valve 411D may also be referred to as a first release (motoring) circuit.

The accumulator part 42 can be a hydraulic circuit element for accumulating the excess working oil within the hydraulic circuit, and releasing the accumulated working oil according to the needs. More particularly, the accumulator part 42 may accumulate the working oil on a braking side (ejection side) of the swing hydraulic motor 21 during a swing deceleration, and release the working oil on a driving side (suction side) of the swing hydraulic motor 21 during a swing acceleration. In addition, the accumulator part 42 may also release the accumulated working oil to its hydraulic actuator during an operation of a hydraulic actuator other than that of the swing hydraulic motor 21. Moreover, the accumulator part 42 may also accumulate the working oil ejected from the main pump 14. In this embodiment, the accumulator part 42 may mainly include a first accumulator 420.

The first accumulator 420 can be a device for accumulating the excess working oil within the hydraulic circuit, and releasing the accumulated working oil according to the needs. In this embodiment, the first accumulator 420 may be a bladder type accumulator that utilizes nitrogen gas, and accumulates or releases the working oil utilizing compressibility of the nitrogen gas and incompressibility of the working oil.

During the swing deceleration, the controller 30 can control the first selector valve 410R to a communicating state in a case in which the pressure on the braking side (ejection side) of the swing hydraulic motor 21 is higher than a pressure of the first accumulator 420, and control the first selector valve 410R to a blocking state in a case in which the pressure on the braking side (ejection side) of the swing hydraulic motor 21 is lower than the pressure of the first accumulator 420. Hence, the controller 30 can prevent the working oil of the first accumulator 420 from flowing to the braking side (ejection side) of the swing hydraulic motor 21 during the swing deceleration. In addition, during the swing acceleration, the controller 30 can control, the second selector valve 410D to the communicating state in the case in which the pressure of the first accumulator 420 is higher than the pressure on the driving side (suction side) of the swing hydraulic motor 21, and control the second selector valve 410D to the blocking state in the case in which the pressure of the first accumulator 420 is lower than the pressure on the driving side (suction side) of the swing hydraulic motor 21. For this reason, the controller 30 can prevent the working oil on the driving side (suction side) of the swing hydraulic motor 21 from flowing to the first accumulator 420 during the swing acceleration.

The second release and accumulation switching part 43 can be a hydraulic circuit element for controlling a flow of the working oil amongst the main pump 14, the control valve 17, and the accumulator part 42. In this embodiment, the second release and accumulation switching part 43 may mainly include a third selector valve 430 and a fourth selector valve 431.

The third selector valve 430 can be a valve for controlling a flow of the working oil to the swing hydraulic motor 21 via the control valve 17. In this embodiment, the third selector valve 430 can be a 2-port 2-position selector valve, and may be formed by a solenoid valve that switches a valve position thereof according to a control signal from the controller 30. In addition, the third selector valve 430 may be formed by a proportional valve that uses the pilot pressure. More particularly, the third selector valve 430 can have a first position and a second position as the valve positions thereof. The first position may be the valve position for communicating the main pump 14 and the accumulator part 42 with respect to a flow control valve 17A for the swing hydraulic motor, within the control valve 17. Moreover, the second position may be the valve position for blocking the main pump 14 and the accumulator part 42 from the control valve 17.

The fourth selector valve 431 can be a valve for controlling a flow of the working oil from the accumulator part 42 to the control valve 1 at the time of the release (motoring) operation of the accumulator 42, and for controlling a flow of the working oil from the main pump 14 to the accumulator 42 at the time of the accumulation (recovery) operation of the accumulator part 42. In this embodiment, the fourth selector valve 431 can be a 2-port 2-position selector valve, and may be formed by a solenoid valve that switches a valve position thereof according to a control signal from the controller 30. In addition, the fourth selector valve 431 may be formed by a proportional valve that uses the pilot pressure. More particularly, the fourth selector valve 431 can have a first position and a second position as the valve positions thereof. The first position may be the valve position for communicating the male pump 14 and the control valve 17 with respect to the accumulator part 42. Moreover, the second position may be the valve position for blocking the main pump 14 and the control valve 17 with respect to the accumulator part 42.

In the following description, the second release and accumulation switching part 43 in the case in which the working oil is controlled to flow from the main pump 14 to the accumulator 42 may also be referred to as a second accumulation (recovery) circuit. The second release and accumulation switching part 43 in the case in which the working oil is controlled to flow from the accumulator part 42 to the control valve 17 may also be referred to as a second release (motoring) circuit.

Figure 4:
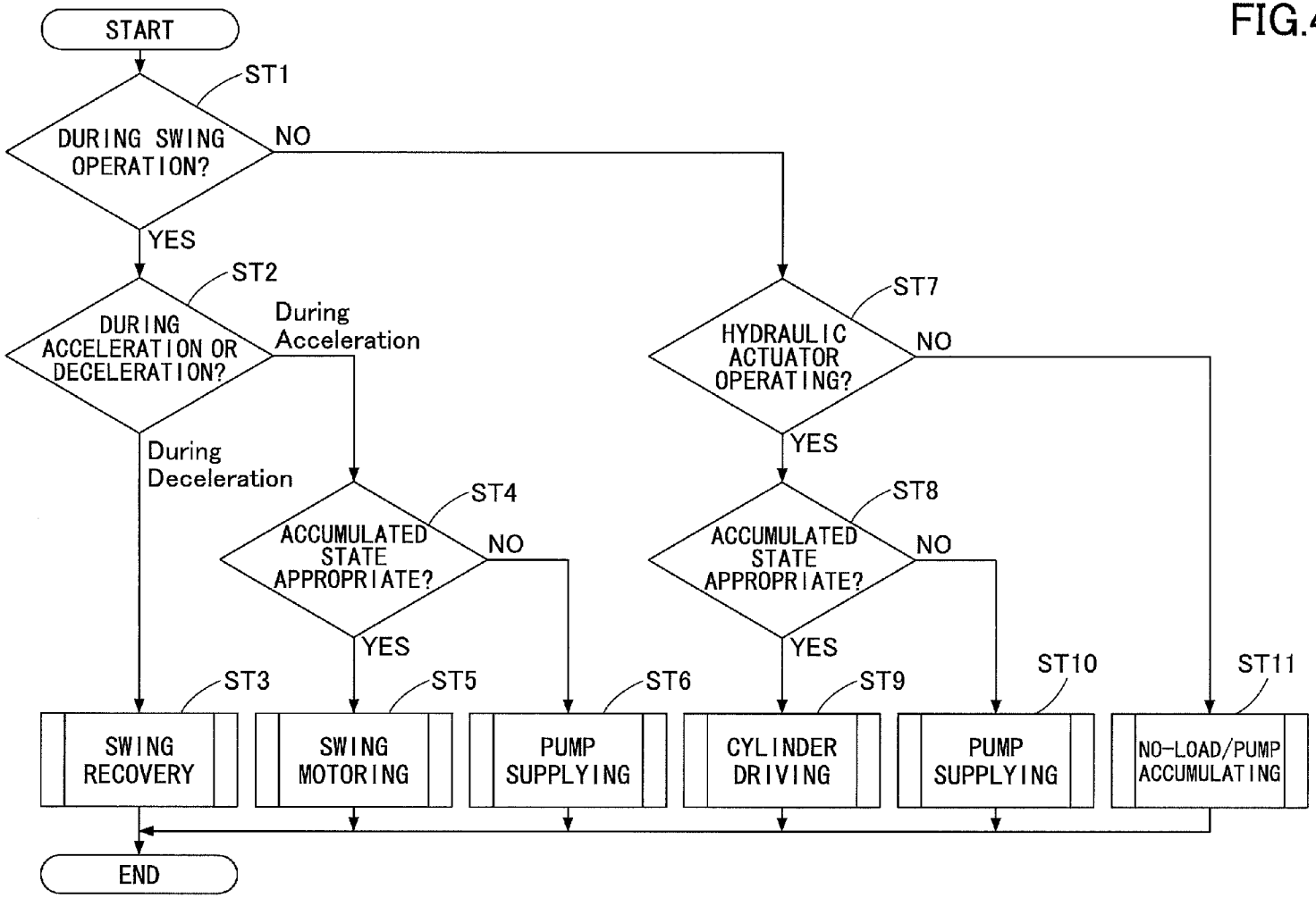
FIG. 4 is a flow chart illustrating a procedure of an accumulation and release process.

Next, a description will be given of a process (hereinafter referred to as a "accumulation and release process") in which the controller 30 controls the accumulation and release of the accumulator part 42, by referring to FIGS. 4 and 5. FIG. 4 is a flow chart illustrating a procedure of the accumulation and release process, and the controller 30 can repeatedly execute this accumulation and release process at a predetermined period. In addition, FIG. 5 is a correspondence table indicating a corresponding relationship of states of the hydraulic circuit of FIG. 3 and states of each of selector valves.

First, the controller 30 can judge whether it is during a swing operation of the hydraulic shovel, based on outputs of various kinds of sensors for detecting states of the hydraulic shovel (step ST1). In this embodiment, the controller 30 can judge whether it is during the swing operation of the hydraulic shovel, based on the operated amounts of the swing operation levers.

When it is judged that it is during the swing operation of the hydraulic shovel (YES in step ST1), the controller 30 can judge whether the hydraulic shovel is during a swing acceleration or a swing deceleration, based on the outputs of the various kinds of sensors (step ST2). In this embodiment, the controller 30 can judge whether it is during the swing acceleration or during the swing deceleration of the hydraulic shovel, based on the operated amounts of the swing operation levers.

When it is judged that it is during the swing deceleration (During Deceleration in step ST2), the controller 30 can control the state of the hydraulic circuit to a "swing recovery" state (step ST3).

As illustrated in FIG. 5, in the "swing recovery" state, the controller 30 can output the control signal with respect to the first selector valve 410E and control the first selector valve 410R to the first position or the third position thereof, in order to communicate the swing control part 40 and the accumulator part 42 via the first accumulator (recovery) circuit. In addition, the controller 30 can output the control signal with respect to the second selector valve 410D and control the second selector valve 410D to the second position thereof, in order to block the communication between the swing control part 40 and the accumulator part 42. Moreover, the controller 30 can output the control signal with respect to the third selector valve 430 and control the third selector valve 430 to the first position thereof, in order to communicate the main pump 14 and the control valve 17. Further, the controller 30 can output the control signal with respect to the fourth selector valve 431 and control the fourth selector valve 431 to the second position thereof, in order to block the communication between the control valve 17 and the accumulator part 42. In the "swing recovery" state, the flow control valve 17A for the swing hydraulic motor, within the control valve 17, can be in the blocking state, that is, in the state in which the communication between the swing hydraulic motor 21 and each of the main pump 14 and the tank is blocked. For this reason, even when the third selector valve 430 is in the first position thereof, the return oil from the swing hydraulic motor 21 will not be elected to the tank via the flow control valve 17A for the swing hydraulic motor. In addition, FIG. 3 illustrates the hydraulic circuit in the "swing recovery" state.

As a result, in the "swing recovery" state, the working oil on the braking side (ejection side) of the swing hydraulic motor 21 can flow to the accumulator part 42 via the first accumulator (recovery) circuit and be accumulated in the first accumulator 420. In addition, because the fourth selector valve 431 is in the blocking state (second position) thereof, the working oil on the braking side (ejection side) of the swing hydraulic motor 21 will not flow to the control valve 17 via the fourth selector valve 431.

In step ST2, when it is judged that it is during the swing acceleration of the hydraulic shovel (During Acceleration in step ST2), the controller 30 can judge whether an accumulation state of the accumulator part 42 is appropriate (step ST4). In this embodiment, the controller 30 can judge whether the pressure of the working oil accumulated in the first accumulator 420 is higher than the pressure on the driving side (suction side) of the swing hydraulic motor 21, based on outputs of the pressure sensors S2L, S2R, and S3. The controller 30 may judge whether the accumulation state of the accumulator part 42 is appropriate, based, on whether the pressure of the working oil accumulated in the first accumulator 420 is a predetermined pressure or higher.

In a case in which the accumulation state is judged to be appropriate, such as a case in which the pressure of the working oil accumulated in the first accumulator 420 is judged to be higher than the pressure on the driving side (suction side) of the swing hydraulic motor 21, for example (YES in step ST4), the controller 30 can control the state of the hydraulic circuit to a "swing motoring" state (step ST5).

As illustrated in FIG. 5, in the "swing motoring" state, the controller 30 can output the control signal with respect to the first selector valve 410R and control the first selector valve 410R to the second position thereof, in order to block the communication between the swing control part 40 and the accumulator part 42. In addition, the controller 30 can output the control signal with respect to the second selector valve 410D and control the second selector valve 410D to the first position or the third position thereof, in order to communicate the swing control part 40 and the accumulator part 42 via the first release (motoring) circuit. Moreover, the controller 30 can output the control signal with respect to the third selector valve 430 and control the third selector valve 430 to the second position thereof, in order to block the communication between the main pump 14 and the control valve 17. Further, the controller 30 can output the control signal with respect to the fourth selector valve 431 and control the fourth selector valve 431 to the second position thereof, in order to block the communication between the control valve 17 and the accumulator part 42.

As a result, in the "swing motoring" state, the working oil from the first accumulator 420 can be released to the driving side (suction side) of the swing hydraulic motor 21 via the first release (motoring) circuit, and the swing hydraulic motor 21 can be driven to swing. In addition, because the fourth selector valve 431 is in the blocking state (second position), the working oil of the first accumulator 420 will not flow to the control valve 17 via the fourth selector valve 431. In the "swing motoring" state, the controller 30 may output the control signal with respect to the third selector valve 430 and control the third selector valve 430 to the first position thereof, in order to provide a communication between the main pump 14 and the control valve 17. In this case, in addition to the working oil released from the first accumulator 420, the working oil ejected from the main pump 14 can be supplied to the driving side (suction side) of the swing hydraulic motor 21.

In step ST4, in a case in which the accumulation state is judged not to be appropriate, such as a case in which the pressure of the working oil accumulated in the first accumulator 420 is judged to be lower than the pressure on the driving side (suction side) of the swing hydraulic motor 21, for example (NO in step ST4), the controller 30 can control the state of the hydraulic circuit to a "pump supplying" state (step ST6).

As illustrated in FIG. 5, in the "pump supplying" state, the controller 30 can output the control signal with respect to the first selector valve 410R and control the first selector valve 410R to the second position thereof, in order to block the communication between the swing control part 40 and the accumulator part 42. In addition, the controller 30 can output the control signal with respect to the second, selector valve 410D and control the second selector valve 410D to the second position thereof, in order to block the communication between the swing control part 40 and the accumulator part 42. Moreover, the controller 30 can output the control signal with respect to the third selector valve 430 and control the third selector valve 430 to the first position thereof, in order to communicate the main pump 14 and the control valve 17. Further, the controller 30 can output the control signal with respect to the fourth selector valve 431 and control the fourth selector valve 431 to the second position thereof, in order to block the communication between the control valve 17 and the accumulator, part 42.

As a result, in the "pump supplying" state, the working oil ejected from the main pump 14 can flow to the driving side (suction side) of the swing hydraulic motor 21, and the swing hydraulic motor 21 can be driven to swing. In addition, because the fourth selector valve 431 is in the blocking state (second position), the working oil ejected from the main pump 14 will not flow to the first accumulator 420 via the fourth selector valve 431.

In step ST1, when it is judged that it is not during the swing operation of the hydraulic shovel (NO in step ST1), the controller 30 can judge whether a hydraulic actuator other than the swing hydraulic motor 21 is operating, based on the outputs of the various kinds of sensors (step S7). In this embodiment, the controller 30 can judge whether the other hydraulic actuator is operating, based on operated amounts of operation levers of the other hydraulic actuator.

When it judged that the other hydraulic actuator (for example, the boom cylinder 7) is operating (YES in step ST7), the controller 30 can judge whether the accumulation state of the accumulator part 42 is appropriate (step ST8). In this embodiment, the controller 30 can judge whether the pressure of the working oil accumulated in the first accumulator 420 is higher than the pressure on a driving side of the boom cylinder 7, based on outputs of pressure sensors (not illustrated) for detecting the pressure of the working oil within the boom cylinder 7. The driving side of the boom cylinder 7 refers to one of a bottom side oil chamber and a rod side oil chamber, having a volume that increases. The driving side of each of the arm cylinder 8 and the bucket cylinder 9 similarly refers to the oil chamber having the volume that increases.

In a case in which the accumulation state is judged to be appropriate, such as a case in which the pressure of the working oil accumulated in the first accumulator 420 is judged to be higher than the pressure on the driving side of the boom cylinder 7, for example (YES in step ST8), the controller 30 can control the state of the hydraulic circuit to a "cylinder driving" state (step ST9).

As illustrated in FIG. 5, in the "cylinder driving" state, the controller 30 can output the control signal with respect to the first selector valve 410R and control the first selector valve 410R to the second position thereof, in order to block the communication between the swing control part 40 and the accumulator part 42. In addition, the controller 30 can output the control signal with respect to the second selector valve 410D and control the second selector valve 410D to the second position thereof, in order to block the communication between the swing control part 40 and the accumulator part 42. Moreover, the controller 30 can output the control signal with respect to the third selector valve 430 and control the third selector valve 430 to the first position thereof, in order to communicate the main pump 14 and the control valve 17. Further, the controller 30 can output the control signal with respect to the fourth valve 431 and control the fourth selector valve 431 to the first position thereof, in order to communicate the control valve 17 and the accumulator part 42 via the second release (motoring) circuit.

As a result, in the "cylinder driving" state, the working oil of the first accumulator 420 can be released to the driving side of the boom cylinder 7 via the second release (motoring) circuit and a flow control valve 17B for cylinder. In addition, because the second selector valve 410D is in the blocking state (second position), the working oil of the first accumulator 420 will not flow to the swing control part 40 (swing hydraulic motor 21) via the second selector valve 410D.

In step ST8, in a case in which the accumulation state is judged not to be appropriate, such as a case in which the pressure of the working oil accumulated in the first accumulator 420 is judged to be lower than the pressure on the driving side of the boom cylinder 7, for example (NO in step ST8), the controller 30 can control the state of the hydraulic circuit to the "pump supplying" state (step ST10).

As illustrated in FIG. 5, in the "pump supplying" state, the controller 30 can output the control signal with respect to the first selector valve 410R and control the first selector valve 410R to the second position thereof, in order to block the communication between the swing control part 40 and the accumulator part 42. In addition, the controller 30 can output the control signal with respect to the second selector valve 410D and control the second selector valve 410D to the second position thereof, in order to block the communication between the swing control part 40 and the accumulator part 42. Moreover, the controller 30 can output the control signal with respect to the third selector valve 430 and control the third selector valve 430 to the first position thereof, in order to communicate the main pump 14 and the control valve 17. Further, the controller 30 can output the control signal with respect to the fourth selector valve 431 and control the fourth selector valve 431 to the second position thereof, in order to block the communication between the control valve 17 and the accumulator part 42.

As a result, in the "pimp supplying", the working oil ejected from the main pump 14 can flow to the driving side of the boom cylinder 7, and drive the boom cylinder 7. In addition, because the fourth selector valve 431 is in the blocking state (second position), the working oil ejected from the main pump 14 will not flow to the first accumulator 420 via the fourth selector valve 431.

In step ST7, when it is judged that none of the other hydraulic actuators is operating (NO in step ST7), the controller 30 can control the state of the hydraulic circuit to a "no-load" or "pump accumulating" state (step ST11).

As illustrated in FIG. 5, in the "no-load" state, the controller 30 can output the control signal with respect to the first selector valve 410R and control the first selector valve 410R to the second position thereof, in order to block the communication between the swing control part 40 and the accumulator part 42. In addition, the controller 30 can output the control signal with respect to the second selector valve 410D and control the second selector valve 410D to the second position thereof, in order to block the communication between the swing control part 40 and the accumulator part 42. Moreover, the controller 30 can output the control signal with respect to the third selector valve 430 and control the third selector valve 430 to the first position thereof, in order to communicate the main pump 14 and the control valve 17. Further, the controller 30 can output the control signal with respect to the fourth selector valve 431 and control the fourth selector valve 431 to the second position thereof, in order to block the communication between the control valve 17 and the accumulator part 42.

As a result, in the "no-load" state, a normal state in which the working oil ejected from the main pump 14 is ejected to the tank via the control valve 17 can be obtained. In addition, because the fourth selector valve 431 is in the blocking state (second, position), the working oil of the first accumulator 420 will not flow to the control valve 17 via the fourth selector valve 431.

In addition, as illustrated in FIG. 5, in the "pump accumulating" state, the controller 30 can output the control signal with respect to the first selector valve 410R and control the first selector valve 410R to the second position thereof, in order to block the communication between the swing control part 40 and the accumulator part 42. Moreover, the controller 30 can output the control signal with respect to the second selector valve 410D and control the second selector valve 410D to the second position thereof, in order to block the communication between, the swing control part 40 and the accumulator part 42. Further, the controller 30 can output the control signal with respect to the third selector valve 430 and control the third selector valve 430 to the second position thereof, in order to block the communication between the main pump 14 and the control valve 17. In addition, the controller 30 can output the control signal with respect to the fourth selector valve 431 and control the fourth selector valve 431 to the first position thereof, in order to communicate the control valve 17 and the accumulator part 42 via the second accumulation (recovery) circuit.

As a result in the "pump accumulating" state, the working oil ejected from the main pump 14 can flow to the accumulator part 42 via the second accumulation (recovery) circuit and be accumulated in the first accumulator 420. The "pomp accumulating" state can continue until the pressure of the working oil of the first accumulator 420 becomes a predetermined pressure, for example, and the state of the hydraulic circuit can switch to the "no-load" state at a point in time when the pressure of the working oil of the first accumulator 420 becomes the predetermined pressure.

In addition, in a case of a composite operation of the swing hydraulic motor 21 and another hydraulic actuator (for example, the boom cylinder 7), the controller 30 may control the state of the hydraulic circuit to the "swing motoring" state when a predetermined condition is satisfied. More particularly, the controller 30 can control the state of the hydraulic circuit to the "swing motoring" state in the case in which the pressure of the working oil ejected from the main pump 14 exceeds a predetermined swing relief pressure due to the large load of the boom cylinder 7. As a result, the working oil of the first accumulator 420 can be released to the driving side (suction side) of the swing hydraulic motor 21, and the swing hydraulic motor 21 can be driven to swing. In addition, because the third selector valve 430 is in the blocking state (second position), the working oil ejected from the main pump 14 will not flow to the driving side (suction side) of the swing hydraulic motor 21 via the flow control valve 17A for the swing hydraulic motor, within the control valve 17. Accordingly, the controller 30 can prevent the main pump 14 from supplying to the swing hydraulic motor 21 the working oil having the pressure higher than the predetermined swing relief pressure. For this reason, the controller 30 can prevent the working oil from being ejected and wasted via the relief valves 400L and 400R. The pressure of the working oil of the first accumulator 320 will not exceed the predetermined swing relief pressure. This is because the first accumulator 320 accumulates the working oil on the braking side (ejection side) of the swing hydraulic motor 21, that is, accumulates only the working oil having the pressure lower than or equal to the predetermined swing relief pressure.

According to the configuration described above, the hydraulic circuit according to this embodiment can release the working oil accumulated in the first accumulator 420 not only to the swing hydraulic motor 21, but also to one or a plurality of hydraulic actuators other than the swing hydraulic motor 21. For this reason, the hydraulic circuit according to this embodiment can efficiently utilize the hydraulic energy accumulated in the first accumulator 420.

In this embodiment, the controller 30 can control the flow of the working oil to the swing hydraulic motor 21 via the control valve 17, by switching the third selector valve 430 between the communicating and blocking states. However, this embodiment is not limited to this configuration. For example, the controller 30 may control the flow of the working oil to the swing hydraulic motor 21 via the control valve 17 by adjusting the pilot pressure of the flow control valve 17A for the swing hydraulic motor, within the control valve 17, by a proportional valve (not illustrated). More particularly, even in a case in which the swing operation levers are operated, the controller 30 may adjust, by the proportional valve, the pilot pressure according to the needs, in order to block the flow of the working oil to the swing hydraulic motor 21 via the flow control valve 17A for the swing hydraulic motor.

In addition, in this embodiment, the controller 30 can judge whether the boom cylinder 7 is operating, after judging whether it is during the swing operation of the hydraulic shovel. Further, the controller 30 can cause the working oil of the first accumulator 420 to be released to the driving side of the boom cylinder 7, in a case in which the pressure of the first accumulator 420 is higher than the pressure on the driving side of the boom cylinder 7 that is operating. However, this embodiment is not limited to this configuration. For example, the controller 30 may judge whether the boom cylinder 7 is operating, before judging whether it is during the swing operation of the hydraulic shovel. In this case, when the pressure of the first accumulator 420 is higher than the pressure on the driving side of the boom cylinder 7 that is operating, the controller 30 causes the working oil of the first accumulator 420 to be released to the driving side of the boom cylinder 7. On the other hand, when the boom cylinder 7 is not operating, the controller 30 can cause the working oil of the first accumulator to be released to the driving side of the swing hydraulic motor 21 when the pressure of the first accumulator 420 is higher than the pressure on the driving side of the swing hydraulic motor 21 that is operating.

Moreover, even in a case in which the pressure of the first accumulator 420 is lower than the pressure on the driving side of the boom cylinder 7 that is operating, the controller 30 can cause the working oil of the first accumulator 42 to be released to the driving side of the swing hydraulic motor 21, in the case in which the pressure of the first accumulator 420 is higher than the pressure on the driving side of the swing hydraulic motor 21 that is operating. Similarly, even in a case in which the pressure of the first accumulator 420 is lower than the pressure on the driving side of the swing hydraulic motor 21 that is operating, the controller 30 can cause the working oil of the first accumulator 420 to be released to the driving side of the boom cylinder 7, in the case in which the pressure of the first accumulator 420 is higher than the pressure on the driving side of the boom cylinder 7 that is operating. The relationship between the swing hydraulic motor 21 and the other hydraulic actuators, other than the boom cylinder 7, may be similar to the relationship described above.

Another Embodiment

Figure 6:
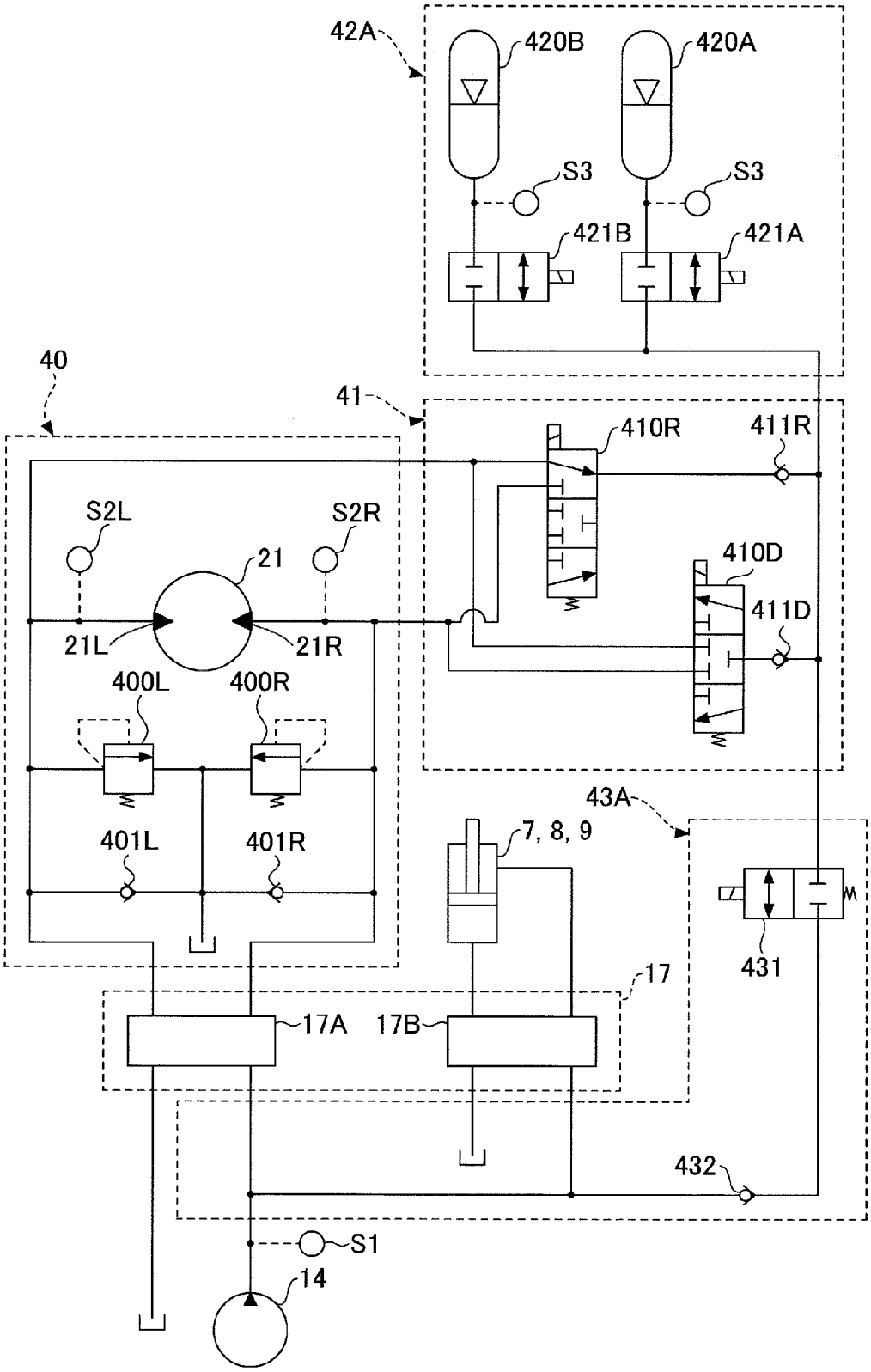
FIG. 6 is a diagram illustrating an example of the main configuration of the hydraulic circuit according to another embodiment.

Next, a description will be given of the accumulation and release of the accumulator provided in the hydraulic shovel according to another embodiment of the present invention, by referring to FIG. 6. FIG. 6 is a diagram illustrating an example of the main configuration of the hydraulic circuit according to this other embodiment, provided on the hydraulic shovel of FIG. 1.

The hydraulic circuit of FIG. 6 differs from the hydraulic circuit of FIG. 3 including the accumulator part 42 having the single accumulator, in that an accumulator part 42A includes two sets of combinations of accumulators and on-off valves. In addition, the hydraulic circuit of FIG. 6 differs from the hydraulic circuit of FIG. 3 in that the third selector valve 430 is omitted, and a second release and accumulation switching part 43A is added with a check valve 432. However, other parts of the hydraulic circuit of FIG. 6 may be the same as those corresponding parts of the hydraulic circuit of FIG. 3. For this reason, a description of the same parts will be omitted, and a detailed description will be given on the differences.

As illustrated in FIG. 6, the accumulator part 42A may mainly include a first accumulator 420A, a second accumulator 420B, a first on-off valve 421A, and a second on-off valve 421B.

The first accumulator 420A and the second accumulator 420B can be devices that accumulate the excess working oil within the hydraulic circuit, and release the accumulated working oil according to the needs. In this other embodiment, each of the accumulators may have an arbitrary capacity, and the capacities of the accumulators may ail be the same or, may be different.

The first on-off valve 421A and the second on-off valve 421B can be valves that open and close according to control signals from, the controller 30, and control the accumulation and release of the first accumulator 420A and the second accumulator 420B, respectively.

In addition, in this other embodiment, a maximum release pressure of the first accumulator 420A is higher than a maximum release pressure of the second accumulator 420B. The "maximum release pressure" refers to a maximum pressure the accumulator is capable of releasing, and is a pressure that is determined by a maximum pressure of the accumulator at the time of the accumulation (recovery) operation. In this other embodiment, the maximum release pressure of the first accumulator 420A can be adjusted to a predetermined value by a control to open and close the first on-off valve 421A. The maximum release pressure of the second accumulator 420B can be adjusted in a similar manner. Hence, by providing a difference between the maximum release pressures, the accumulator part 42A can select one of the first accumulator 420A and the second accumulator 420B from which the working oil is to be released. This selection may be made based on the state of the hydraulic actuator other than the swing hydraulic motor 21, which may be detected from the operated amount of the operation levers, the discharge pressure of the main pump 14, or the like, for example.

On the other hand, as illustrated in FIG. 6, the second release and accumulation switching part 43A, as a second release (motoring) circuit, may mainly include a fourth selection valve 431 and a check valve 432.

The fourth selector valve 431 can be a 2-port 2-position selector valve, similar to that of the embodiment described above, and may be formed by a solenoid valve that switches a valve position thereof according to a control signal from the controller 30. In addition, the fourth selector valve 431 may be formed by a proportional valve that uses the pilot pressure. More particularly, the fourth selector valve 431 can have a first position and a second position as the valve positions thereof. The first position may be the valve position for communicating the main pump 14 and the control valve 17 with respect to the accumulator part 42A. Moreover, the second position may be the valve position for blocking the main pump 14 and the control valve 17 with respect to the accumulator part 42A.

The check valve 432 can be a valve that prevents the working oil ejected from the main pump 14 from flowing to the accumulator part 42A.

According to this other embodiment, the controller 30 will not control the state of the hydraulic circuit to the "pump accumulating" state, because the check valve 432 prevents the flow of the working oil from the main pump 14 to the accumulator part 42A. For this reason, at the time of the release (motoring) operation of the accumulator part 42A, the fourth selector valve 431 merely controls the flow of the working oil from the accumulator part 42A to the control valve 17, and will not control the flow of the working oil from the main pump 14 to the accumulator part 42A at the time of the accumulation (recovery) operation of the accumulator part 42A.

In addition, in the hydraulic circuit according to this other embodiment, the working oil elected from the main pump 14, or a combination of the working oil ejected from the main pump 14 and the working oil accumulated in the accumulator part 42A, can be used to drive the swing hydraulic motor 21, because the third selector valve 430 illustrated in FIG. 3 is omitted.

However, the hydraulic circuit according to this other embodiment may tolerate the flow of the working oil from the main pump 14 to the accumulator part 42A by omitting the check valve 432, and permit the state of the hydraulic circuit to be controlled to the "pump accumulating" state. Moreover, the hydraulic circuit according to this other embodiment may be provided with the third selector valve 430 or a constituent element for realizing functions similar to those of the third selector valve 430, in order to enable driving of the swing hydraulic motor 21 using only the working oil accumulated in the accumulator part 42A.

According to the configuration described above, the hydraulic circuit according to this other embodiment can obtain the effect of enabling selection of the accumulator at an accumulating destination that is to accumulate the working oil from a plurality of accumulators, in addition to obtaining the effects obtainable by the hydraulic circuit according to the embodiment described above. More particularly, at the time of the accumulation (recovery) operation, the accumulator at the accumulating destination that is to accumulate the working oil can be made selectable from the plurality of accumulators having different maximum release pressures, according to the pressure of the working oil on the braking side of the swing hydraulic motor 21. As a result, the accumulation (recovery) operation can be performed even when the pressure of the working oil on the braking side is low.

In addition, in the hydraulic circuit according to this other embodiment, at the time of the release (motoring) operation, the accumulator at a supply source of the working oil can be selectable from the plurality of accumulators having the different maximum release pressures, according to a requested release pressure. As a result, the accumulators having the low release pressure can be utilized more efficiently.

A release pressure range, that is determined by the maximum release pressure and a minimum release pressure, may be set with respect to the first accumulator 420A and the second accumulator 420B. In this case, at the time of the accumulation (recovery) operation, the working oil on the braking side of the swing hydraulic motor 21 can be accumulated in the accumulator having the release pressure range suited for the pressure of the working oil on the braking side.

In addition, in this other embodiment, one of the plurality of accumulators can be selected as the accumulating destination of the working oil at the time of the accumulation (recovery) operation, or can be selected as the supply source of the working oil at the time of the release (motoring) operation. In other words, the plurality of accumulators can respectively accumulate or release at different timings. For this reason, each of the plurality of accumulators can accumulate or release the working oil without being unaffected by the pressures of the other accumulators. However, this other embodiment is not limited to this configuration. For example, two or more accumulators may be simultaneously selected as the accumulating destination or the supplying source. That is, two or more accumulators may accumulate or release at partially or completely overlapping timings.

Further Embodiment

Figure 7:
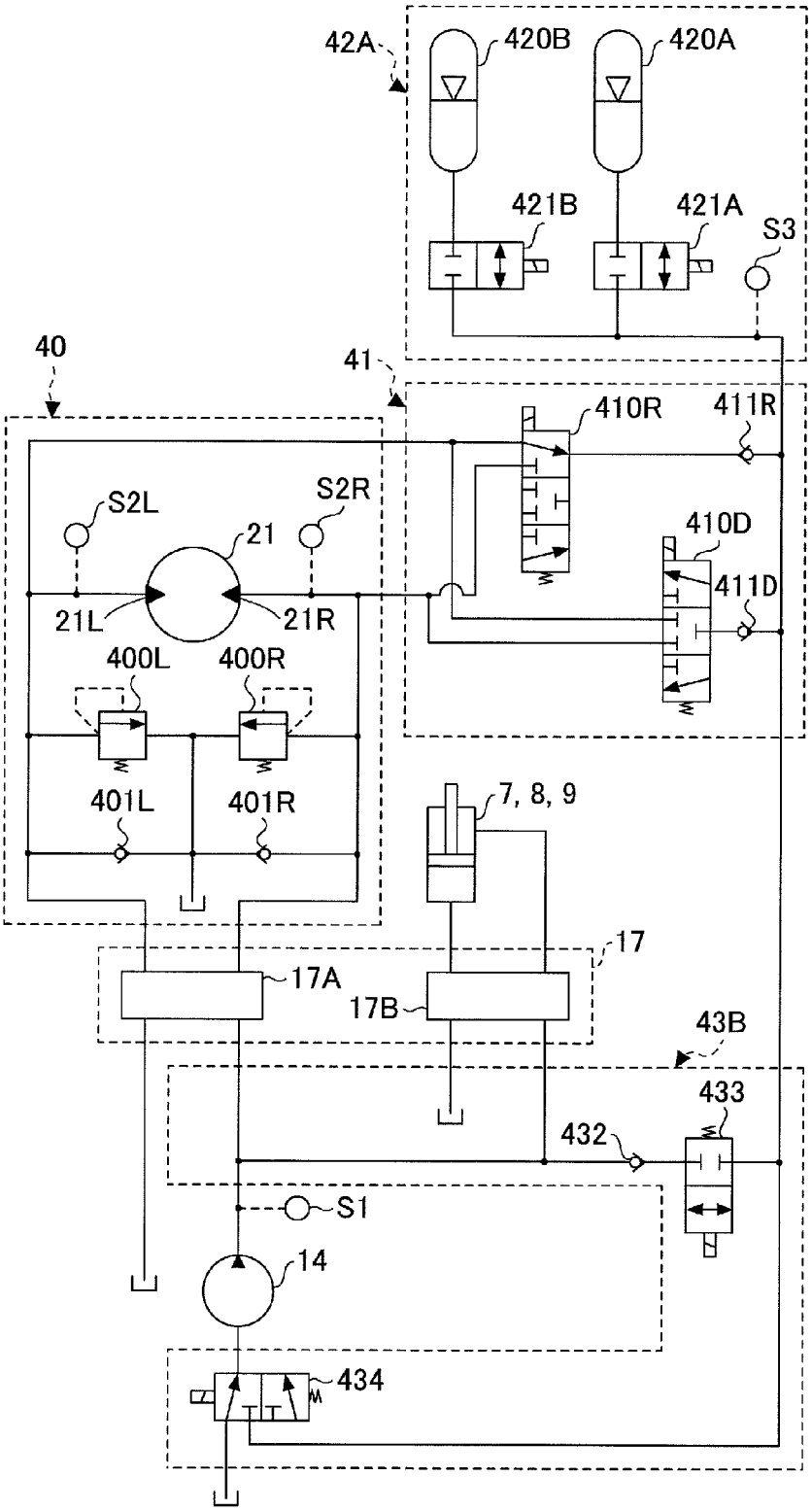
FIG. 7 is a diagram illustrating an example of the main configuration of the hydraulic circuit according to a further embodiment.

Next, a description will be given of the accumulation and release of the accumulator provided in the hydraulic shovel according to a further embodiment of the present invention, by referring to FIG. 7. FIG. 7 is a diagram illustrating an example of the main configuration of the hydraulic circuit according to this further embodiment, provided on the hydraulic shovel of FIG. 1.

The hydraulic circuit of FIG. 7 differs from the hydraulic circuit of FIG. 6, in that a second release and accumulation switching part 43B includes a fifth selector valve 433 and a sixth selector valve 434, in place of the fourth selector valve 431. However, other parts of the hydraulic circuit of FIG. 7 may be the same as those corresponding parts of the hydraulic circuit of FIG. 6. For this reason, a description of the same parts will be omitted, and a detailed description will be given on the differences.

The second release and accumulation switching part 43B, which is provided as the second release (motoring) circuit, can be a constituent element of the hydraulic circuit, connecting the accumulator 42A and an upstream side (suction side) or a downstream side (ejection side) of the main pump 14. In this further embodiment, the second release and accumulation switching part 43B may mainly include the fifth selector valve 433 and the sixth selector valve 434.

The fifth selector valve 433 can be a valve that controls the flow of the working oil from the accumulator part 42A, passing a junction point on the downstream side of the main pump 14, and moving towards the control valve 17, at the time of the release (motoring) operation of the accumulator part 42A.

In this further embodiment, the fifth selector valve 433 can be a 2-port 2-position selector valve, and may be formed by a solenoid valve that switches a valve position thereof according to a control signal from the controller 30. In addition, the fifth selector valve 433 may be formed by a proportional valve that uses the pilot pressure. More particularly, the fifth selector valve 433 can have a first position, and a second position as the valve positions thereof. The first position may be the valve position for communicating the accumulator part 42A and the control valve 17 via the junction point on the downstream side of the main pump 14. Moreover, the second position may be the valve position for blocking the accumulator part 42A and the control valve 17 from each other.

The sixth selector valve 434 cart be a valve that controls the flow of the working oil from the accumulator part 42A, passing a junction point on the upstream side of the main pump 14, and moving towards the control valve 17, at the time of the release (motoring) operation of the accumulator part 42A.

In this further embodiment, the sixth selector valve 434 can be a 2-port 2-position selector valve, and may be formed by a solenoid valve that switches a valve position thereof according to a control signal from the controller 30. In addition, the sixth selector valve 434 may be formed by a proportional valve that uses the pilot pressure. More particularly, the sixth selector valve 434 can have a first position and a second position as the valve positions thereof. The first position may be the valve position for communicating the accumulator part 42A and the control valve 17 via the junction point on the upstream side of the main pump 14. Moreover, the second position may be the valve position for blocking the accumulator part 42A and the control valve 17 from each other.

In a case in which the sixth selector valve 434 is at the first position thereof, the communication between the main pump 14 and the tank can be blocked at the upstream side of the main pump 14, and the communication between, the main pump 14 and the accumulator part 42A can be provided. In addition, the main pump 14 can suck in the working oil released from the accumulator part 42A and having a relatively high pressure, and eject this working oil towards the control valve 17. As a result, a suction horsepower (torque required to eject a predetermined amount of the working oil) of the main pump 14 can be reduced compared to a case in which the working oil having a relatively low pressure is sucked in from the tank and ejected, and it is possible to promote energy saving. Further, responsiveness of the main pump 14 in response to the control of the amount of ejection can be improved.

Moreover, in a case in which the sixth selector valve 434 is at the second position, the communication between the main pump 14 and the tank can be provided at the upstream, side of the main pump 14, and the communication between the main pump 14 and the accumulator part 42A can be blocked. In this case, the main pump 14 can suck in the working oil having a relatively low pressure from the tank, and eject this working oil towards the control valve 17.

At the time of the release (motoring) operation, the controller 30 can close the first release (motoring) circuit, and open the second release (motoring) circuit 43B, in order to supply the working oil of the accumulator part 42A to the control valve 17. Alternatively, at the time of the release (motoring) operation, the controller 30 can open the first release (motoring) circuit, and close the second release (motoring) circuit 43B, in order to supply the working oil of the accumulator part 42A to the swing hydraulic motor 21. At the time of the release (motoring) operation, the controller 30 may open both the first release (motoring) circuit and the second release (motoring) circuit 43B, and supply the working oil of the accumulator part 42A to both the swing hydraulic motor 21 and the control valve 17.

In a case in which the controller 30 opens the second release (motoring) circuit 43B, one of the fifth selector valve 433 and the sixth selector valve 434 can be controlled to the first position thereof, and the other can be controlled to the second position thereof.

More particularly, when the hydraulic actuator is operated, the controller 30 can control the fifth selector valve 433 to the first position thereof and the sixth selector valve 434 to the second position thereof, in a case in which the pressure of the accumulator, part 42A is higher than the pressure on the driving side of this hydraulic actuator. Further, the controller 30 can release the working oil of the accumulator part 42A towards the control valve 17, via the junction point on the downstream side of the main pump 14.

On the other hand, when the hydraulic actuator is operated, the controller 30 can control the fifth selector valve 433 to the second position thereof and the sixth selector valve 434 to the first position thereof, in a case in which the pressure of the accumulator part 42A is lower than the pressure on the driving side of this hydraulic actuator. Further, the controller 30 can release the working oil of the accumulator part 42A towards the main pump 14, via the junction point on the upstream side of the main pump 14. The main pump 14 can suck in the working oil released from the accumulator part 42A and eject this working oil towards the downstream side, in place of sucking in the working oil from the tank. As a result, the suction horsepower of the main pump 14 can be reduced compared to the case in which the working oil having the relatively low pressure is sucked in from the tank and ejected.

According to the configuration described above, the hydraulic circuit according to this further embodiment can obtain the effect of enabling the release (motoring) operation of the accumulator part 42A to be executed even in a case in which the pressure of the accumulator part 42A is lower than the pressure on the driving side of the hydraulic actuator that is to be operated, in addition to obtaining the effects obtainable by the hydraulic circuit according to the embodiments described above.

In addition, in the hydraulic circuit according to this further embodiment, because the third selector valve 430 illustrated in FIG. 3 is omitted, the working oil ejected from the main pump 14, or the combination of the working oil ejected from the main pump 14 and the working oil accumulated in the accumulator part 42A, can be used to drive the swing hydraulic motor 21.

However, the hydraulic circuit according to this further embodiment may tolerate the flow of the working oil from the main pump 14 to the accumulator part 42A by omitting the check valve 432, and permit the state of the hydraulic circuit to be controlled to the "pump accumulating" state. Moreover, the hydraulic circuit according to this further embodiment may be provided with the third selector valve 430 or a constituent element for realizing functions similar to those of the third selector valve 430, in order to enable driving of the swing hydraulic motor 21 using only the working oil accumulated in the accumulator part 42A.

Further, in this further embodiment, the accumulator part 42A may include the two sets of the combinations of the accumulators and the on-off valves, however, the accumulator part 42A may be formed by a single accumulator, similarly as in the case of the accumulator part 42 of the embodiment described above.

In addition, in this further embodiment, the second release and accumulation switching part 43B which is provided as the second release (motoring) circuit can be configured to merge the working oil from the accumulator part 42A at the junction point on the upstream side or on the downstream side of the main pump 14. However, this further embodiment is not limited to this configuration, and for example, it is possible to employ a configuration in which the second release (motoring) circuit 43B omits a conduit line including the check valve 432 and the fifth selector valve 433, and the working oil from the accumulator part 42A is permitted to merge only at the junction point on the upstream side of the main pump 14.

Moreover, in a case in which the accumulation of all of the accumulators ends in the state in which the accumulation (recovery) operation is performed, or in a case in which a sufficient accumulation is already made in all of the accumulators at a point in time when the accumulation (recovery) operation is started, the return oil from the swing hydraulic motor 21 may be merged at the junction point on the upstream side or at the junction point on the downstream side of the main pump 14, using the second release and accumulation switching part 43B.

According to the certain embodiments, it is possible to provide a shovel that can efficiently use an accumulator.

It should be understood that the invention is not limited to the above-described embodiments, but may be modified into various forms on the basis of the spirit of the invention. Additionally, the modifications are included in the scope of the invention.

For example, in the embodiments described above, the working oil accumulated in the accumulator 420 can be released towards the swing hydraulic motor 21, or one or a plurality of hydraulic actuators other than the swing hydraulic motor 21. However, the embodiments are not limited to this configuration. For example, the working oil accumulated in the accumulator 420 may be released simultaneously towards the swing hydraulic motor 21, and the one or plurality of hydraulic actuators other than the swing hydraulic motor 21.

What is claimed is:

1. A shovel comprising:

a main pump;

hydraulic actuators including a swing hydraulic motor;

a control valve configured to control a flow of a working oil between the main pump and the hydraulic actuators;

an accumulator part configured to release the working oil between the main pump and the control valve, and between the swing hydraulic motor and the control valve; and a selector valve provided in a line that connects the accumulator part and a junction point between the main pump and the control valve, wherein, during operation of a hydraulic actuator other than the swing hydraulic motor, the selector valve assumes a communicating valve position, and the accumulator part releases the working oil between the main pump and the control valve.

2. The shovel as claimed in claim 1, wherein the accumulator part accumulates the working oil of the swing hydraulic motor flowing from between the swing hydraulic motor and the control valve, during a swing deceleration.

3. The shovel as claimed in claim 2, wherein the selector valve assumes a blocking valve position when a pressure of the working oil accumulated in the accumulator part is lower than a pressure of a driving side of a hydraulic actuator other than the swing hydraulic motor.

4. The shovel as claimed in claim 2, wherein the accumulator part releases the working oil between the swing hydraulic motor and the control valve, during a swing acceleration.

5. The shovel as claimed in claim 2, wherein the accumulator part is formed by a plurality of accumulators.

6. The shovel as claimed in claim 1, wherein the selector valve assumes a blocking valve position when a pressure of the working oil accumulated in the accumulator part is lower than a pressure of a driving side of a hydraulic actuator other than the swing hydraulic motor.

7. The shovel as claimed in claim 6, wherein the accumulator part releases the working oil between the swing hydraulic motor and the control valve, during a swing acceleration.

8. The shovel as claimed in claim 6, wherein the accumulator part is formed by a plurality of accumulators.

9. The shovel as claimed in claim 1, wherein the accumulator part releases the working oil between the swing hydraulic motor and the control valve, during a swing acceleration.

10. The shovel as claimed in claim 9, wherein the accumulator part is forming by a plurality of accumulators.

11. The shovel as claimed in claim 1, wherein the accumulator part is formed by a plurality of accumulators.

12. The shovel as claimed in claim 11, wherein one of the plurality of accumulators accumulates or releases the working oil at a timing different from another one of the plurality of accumulators.

13. The shovel as claimed in claim 1, wherein the accumulator part can release the working oil at an upstream of the main pump.

14. A shovel comprising:

a main pump;

hydraulic actuators including a swing hydraulic motor;

a control valve configured to control a flow of a working oil between the main pump and the hydraulic actuators; and an accumulator part configured to release the working oil between the main pump and the control valve, and between the swing hydraulic motor and the control valve, wherein the accumulator part releases the working oil between the main pump and the control valve, during operation of a hydraulic actuator other than the swing hydraulic motor.

* * * * *